US009371168B1

(12) United States Patent
Rick

(10) Patent No.: US 9,371,168 B1
(45) Date of Patent: Jun. 21, 2016

(54) TAMPER-RESISTANT CONTAINER LINER

(71) Applicant: Charles Rick, Old Westbury, NY (US)

(72) Inventor: Charles Rick, Old Westbury, NY (US)

(73) Assignee: M & G PACKAGING CORP., Floral Park, NY (US)

( * ) Notice: Subject to any disclaimer, the term of this patent is extended or adjusted under 35 U.S.C. 154(b) by 0 days.

(21) Appl. No.: 14/576,827

(22) Filed: Dec. 19, 2014

(51) Int. Cl.

| | |
|---|---|
| ***B65D 81/00*** | (2006.01) |
| ***B65D 81/127*** | (2006.01) |
| ***B65D 90/04*** | (2006.01) |
| ***B65D 81/05*** | (2006.01) |

(52) U.S. Cl.
CPC ..... *B65D 81/127* (2013.01); *B65D 81/053* (2013.01); *B65D 90/04* (2013.01)

(58) Field of Classification Search
CPC ..... B65D 3/22; B65D 5/56; B65D 25/14; B65D 81/053; B65D 81/127; B65D 81/1275; B65D 90/04; B65D 90/046
USPC ..... 206/524.2–524.4, 524.6, 1.5, 386, 206/595–600, 80, 7; 220/62.19–62.22; 229/5.81, 5.84, 117.35
See application file for complete search history.

(56) References Cited

U.S. PATENT DOCUMENTS

| | | | | | |
|---|---|---|---|---|---|
| 4,170,312 | A * | 10/1979 | Lloyd | B65D 7/18 | 206/522 |
| 4,431,316 | A * | 2/1984 | Massey | B65D 88/165 | 206/524.2 |
| 5,285,957 | A * | 2/1994 | Halsell | B65D 65/403 | 229/5.81 |
| 6,000,604 | A * | 12/1999 | Lapoint, III | B65D 88/1625 | 229/117.35 |
| 6,520,403 | B1 * | 2/2003 | Lapoint, III | B65D 77/062 | 229/117.35 |
| 7,967,161 | B2 * | 6/2011 | Townsend | B65D 90/047 | 220/1.6 |
| 8,079,132 | B2 * | 12/2011 | Clayman | G06K 19/07327 | 29/403.1 |
| 8,420,140 | B2 * | 4/2013 | Nafisi-Movaghar | B65D 81/24 | 205/740 |
| 2011/0290865 | A1 * | 12/2011 | Black | B65D 5/28 | 229/5.81 |
| 2012/0318695 | A1 * | 12/2012 | Seber | B65D 75/22 | 206/524.6 |
| 2014/0124401 | A1 * | 5/2014 | Seber | B32B 5/028 | 206/461 |

* cited by examiner

*Primary Examiner* — Bryon Gehman
(74) *Attorney, Agent, or Firm* — Ladas & Parry LLP

(57) ABSTRACT

A protective liner for shipping containers having top, bottom and side walls has a plurality of panels each having peripheral dimensions chosen to permit each panel to be positioned proximate an inner surface of a different one of the container walls and to overlie substantially the entire inner surface of the wall. Each panel has a cut-resistant weave layer, which may be of galvanized steel. The weave layer may be sandwiched between protective fabric outer layers, which provide a peripheral flap for the panel allowing it to be joined to other panels. The edges of the weave layer may also be covered with a protective foam edging.

14 Claims, 6 Drawing Sheets

TAMPER-RESISTANT CONTAINER LINER

The present invention relates to a packaging construction, and in particular to a packaging construction having increased security against tampering and vandalism.

BACKGROUND OF THE INVENTION

The shipment of goods, worldwide, is a multi-billion dollar industry. In 2013, for example, the amount of freight carried by U.S. airlines in domestic shipments exceeded 12 million ton-miles, while total shipments (domestic and international, exceeded 61 million ton-miles. As domestic and international commerce and shipping increases, so does the amount of pilferage. While the amount of pilferage is difficult to determine with accuracy, estimates of losses in the U.S. alone have ranges from 3-10 billion dollars and up yearly.

Much of the losses occur during loading and unloading, as well as in warehousing of the goods, as opposed to diversion of a shipment during actual transport. And while pilferage and loss can result from the physical diversion of the bulk packaging during loading, unloading and warehousing, losses also result from the opening of packaging and the removal of the individual goods packed therein. The criminals typically cut through the packaging to extract the contents, the packaging remaining in place.

As much shipping is done in multi-layer corrugated fiberboard cartons, sometimes referred to as "Gaylord" boxes, access to a carton's interior by cutting through the container walls is relatively easy. The use of stronger packaging, such as metallic or composite cartons, significantly increases the overall weight and cost of the packaging as well as the shipping cost itself. While tamper resistant tapes are well known, as are sealing systems that indicate if tampering has occurred, there has been little success in formulating tamper resistant systems that are lightweight and protect the contents from pilferage, as opposed to providing evidence of such pilferage after it has occurred and the container contents removed, and that can be incorporated into or used with otherwise conventional packaging constructions.

It is accordingly a purpose of the present invention to provide a protective layer for conventional packaging, and especially Gaylord boxes, which provides increased protection against unauthorized entry into the container by cutting through the walls thereof.

A further purpose of the invention is to provide a protective layer that can be installed within conventional packaging without modification of the container in which it is installed.

Yet a further purpose of the invention is to provide a protective layer that can cover all inner surfaces of a container, and that can be easily assembled within a container and which can be manufactured in a variety of sizes.

BRIEF DESCRIPTION OF THE INVENTION

In accordance with the above and other purposes, the present invention comprises a set of protective panels sized to fit adjacent each of the inner surfaces or walls (including the top and bottom) of a conventional corrugated fiberboard shipping container or carton, providing an inner lining for the container into which the goods to be shipped are placed. The panels are provided either as individual wall-lining elements or in the form of sub-assemblies that are sized to cover two or more container walls, wherein a set of the panels comprises side, top and bottom wall panels which, when interconnected, provide a complete inner barrier layer against entry into the container interior, even if the container walls proper are breached. As heavy duty shipping containers or cartons are typically assembled at the shipping site, the panels of the present invention can likewise be installed within the carton when the carton itself is assembled and prepared for loading.

Each of the panels comprises a lightweight mesh, such as a metallic mesh core encased within tough, typically non-woven, fabric layers. The mesh, while being relatively light weight, provides a high degree of tensile strength, making it difficult for the panels to be cut through or otherwise deformed to provide access therethrough. Each panel may be dimensioned to cover one carton wall. Alternatively, two or more so-dimensioned panels may be flexibly joined along common edges to form a multiple-wall element which can be stored in a folded configuration and opened up for assembly within a carton. Upon installation individual panels can be joined together by edge connectors. When fully installed the panels form a lining chamber conforming to the size and shape of the carton in which they are installed.

Upon delivery and opening of the container the panels can be easily disconnected from each other for access to the enclosed goods. The panels can be removed from the container for re-use if desired.

BRIEF DESCRIPTION OF THE DRAWINGS

A full understanding of the invention will be attained upon consideration of the following detailed description of an illustrative embodiment thereof in association with the annexed drawings, wherein.

DETAILED DESCRIPTION OF THE INVENTION

Figure 1:
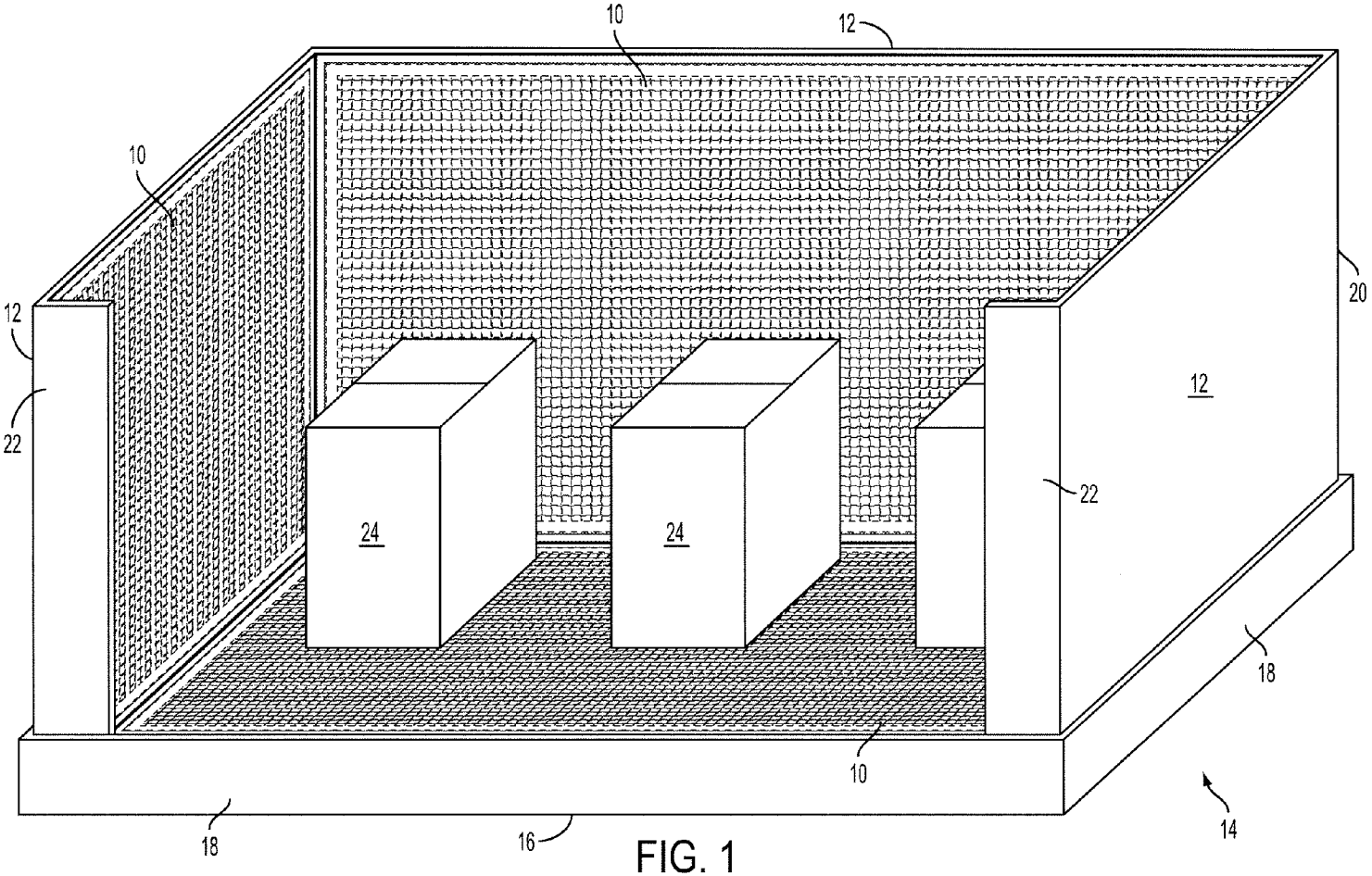
FIG. 1 is a perspective view of a partially assembled conventional shipping container showing the liner panels of the present invention located on its inner walls.

With initial reference to FIG. 1, the present invention comprises a series of panels 10 configured and dimensioned to generally abut and line the inner surfaces of the walls 12 of a shipping container or carton 14. In the type of carton shown, a sidewall unit 20 comprising back, right and left side wall panels and front wall side edge portions 22 is assembled and supported upon bottom panel 16, formed with side riser portions 18. Such a construction facilitates the loading of the carton's contents, such as boxes 24. A separate front wall panel (not shown) is installed across the open front after the container is loaded, and a top cover (also not shown) is then applied to complete the container. The container is then sealed with tapes, strapping and/or other sealing means as known in the art.

As further depicted in FIG. 1, and in accordance with the present invention, each of the container wall panels is provided with a lining panel 26. The panels abut the corresponding container panels and provide an inner layer of protection against unwanted entry into the container interior through a panel. For ease in installing the panels, they may be sized to be slightly smaller than the inner dimensions of the container in which they are to be placed.

Figure 2:
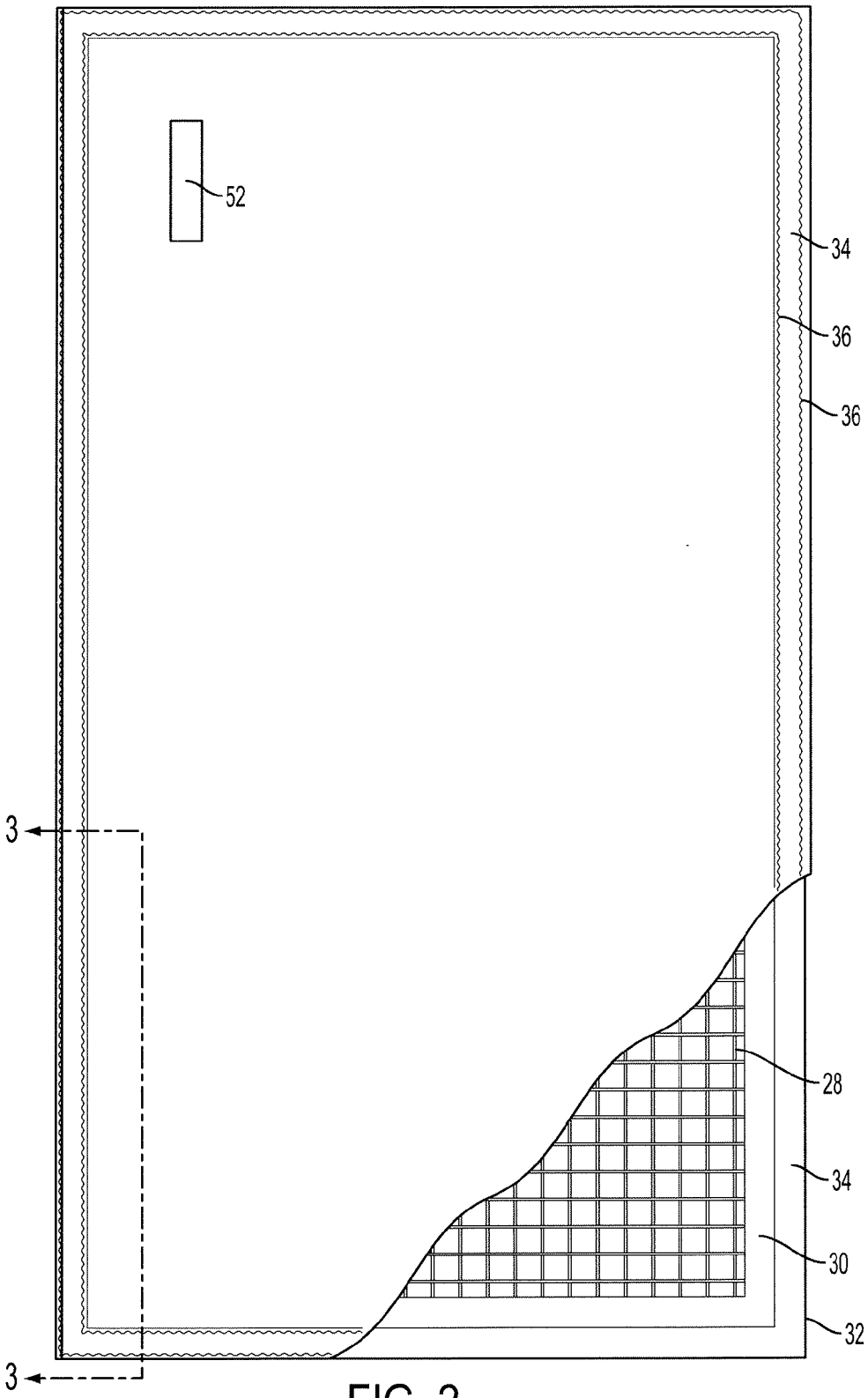
FIG. 2 is a plan view, partially broken away, to illustrate the construction of a typical panel of the invention.
Figure 3:
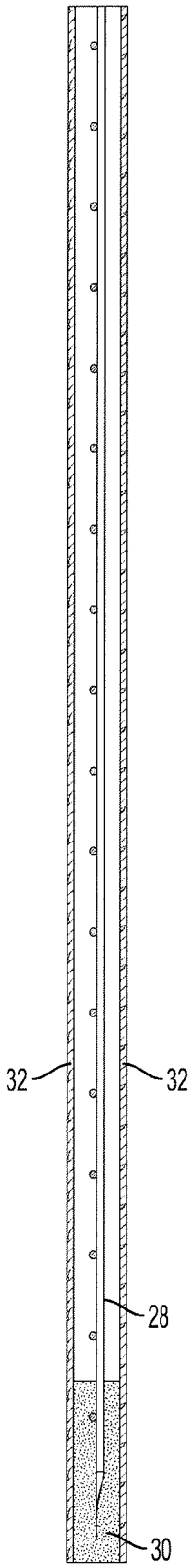
FIG. 3 is a partial section view taken along line 3-3 of FIG. 2.
Figure 4A:
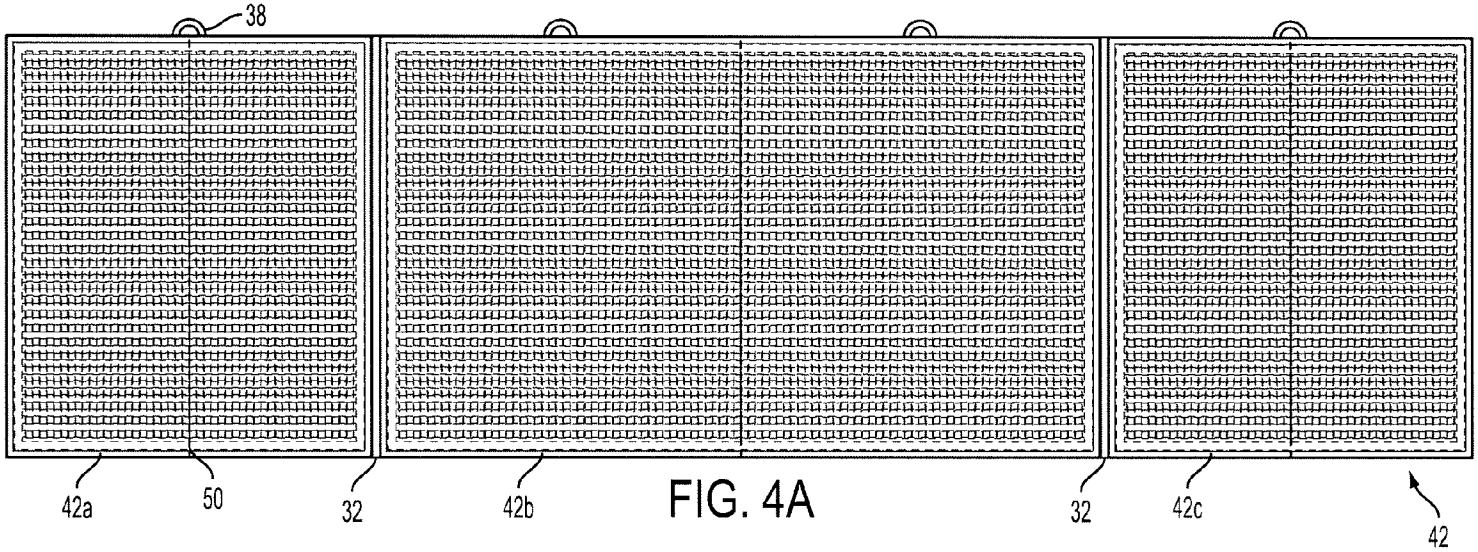
FIGS. 4A-4D are plan views a set of panels for use in connection with a typical container.
Figure 4B:
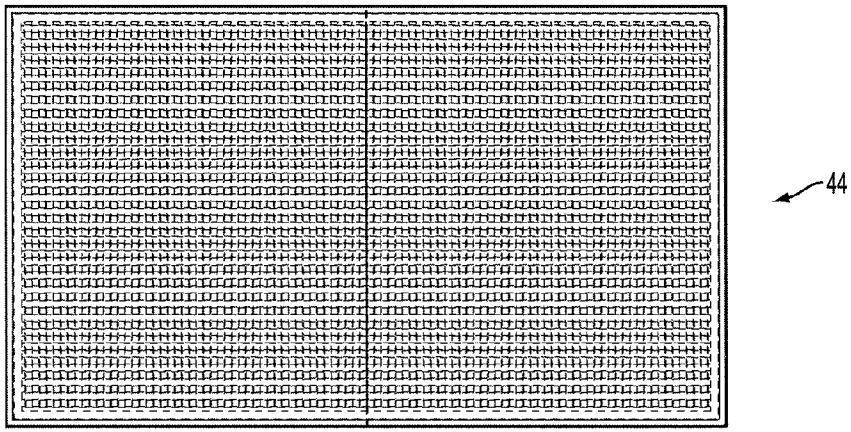
Figure 4C:
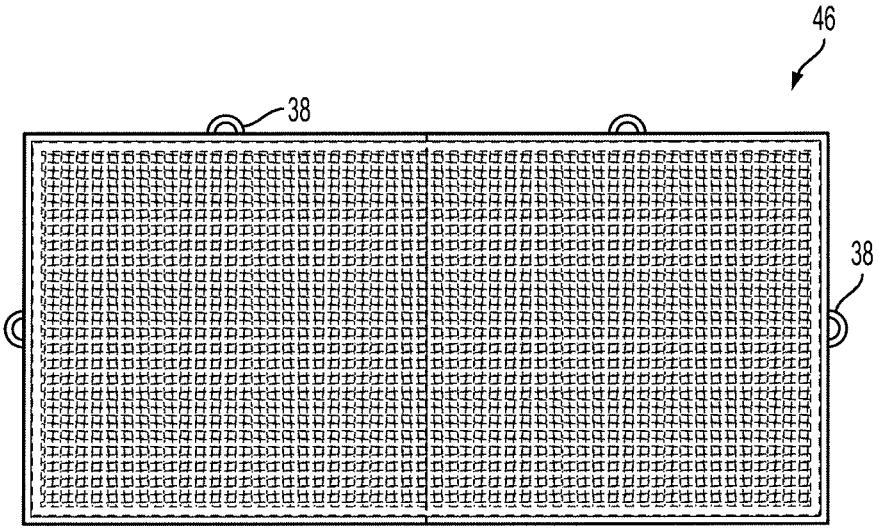
Figure 4D:
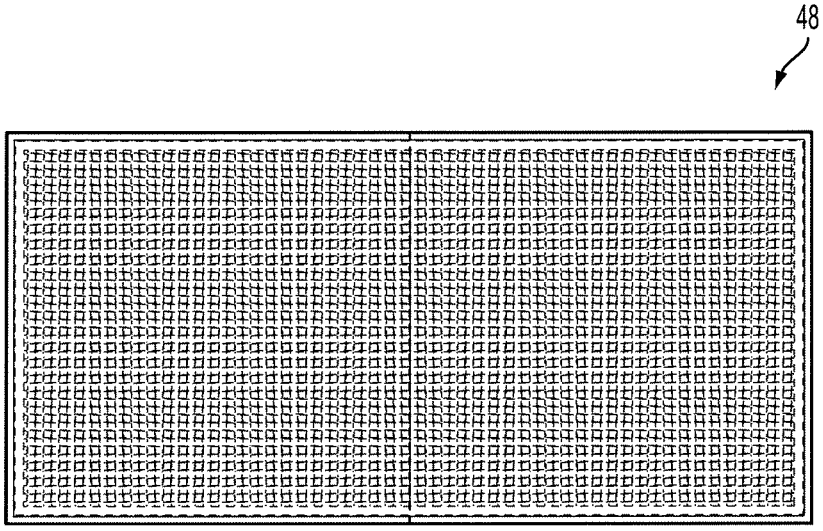

As illustrated in FIGS. 2 and 3, each of the panels comprises an inner core or layer 28 of a tough cut-resistant material, preferably in an open weave form, chosen to be resistant to cutting or deformation for penetration. A preferred construction is metallic open weave construction. The weave may be of galvanized iron or steel, and may be formed of 0.7 mm diameter wires in a 13-20 mm gage square mesh weave. The intersection points of the strands are preferably joined by tack welding or the like. Other materials having similar cut and penetration resistant qualities can also be used. They may include appropriate synthetic plastics and fiberglass weaves.

The exterior edges of the inner core are covered to protect against container damage or injury to personnel by wrapping with a protective edge binding, such as foam tape 30. The tape may be double sided with adhesive, to allow the tape to stay in position around the core edge and to bond with outer panel layers, as will be discussed.

The edge-protected metallic weave layer is covered on both sides by cover layers 32, which protect the container walls and contents from contact with the metal weave, provide a finished appearance, and provide for interconnection between panels upon installation. The layers 32 may be of any appropriate durable material, preferably a non-woven fabric to avoid fraying, and may be a polypropylene spunlace/spunweave fabric having a mass in the range of 40 g/m$^2$. The fabric layers extend out past the tape binding 28, forming a flexible peripheral flap 34, and are adhered to the edges of the inner core by virtue of the tape 30's exposed adhesive surface. The fabric layers are joined together about their common peripheries, such as by a pair of stich lines 36 along the edges of the flap 34.

Figure 5:
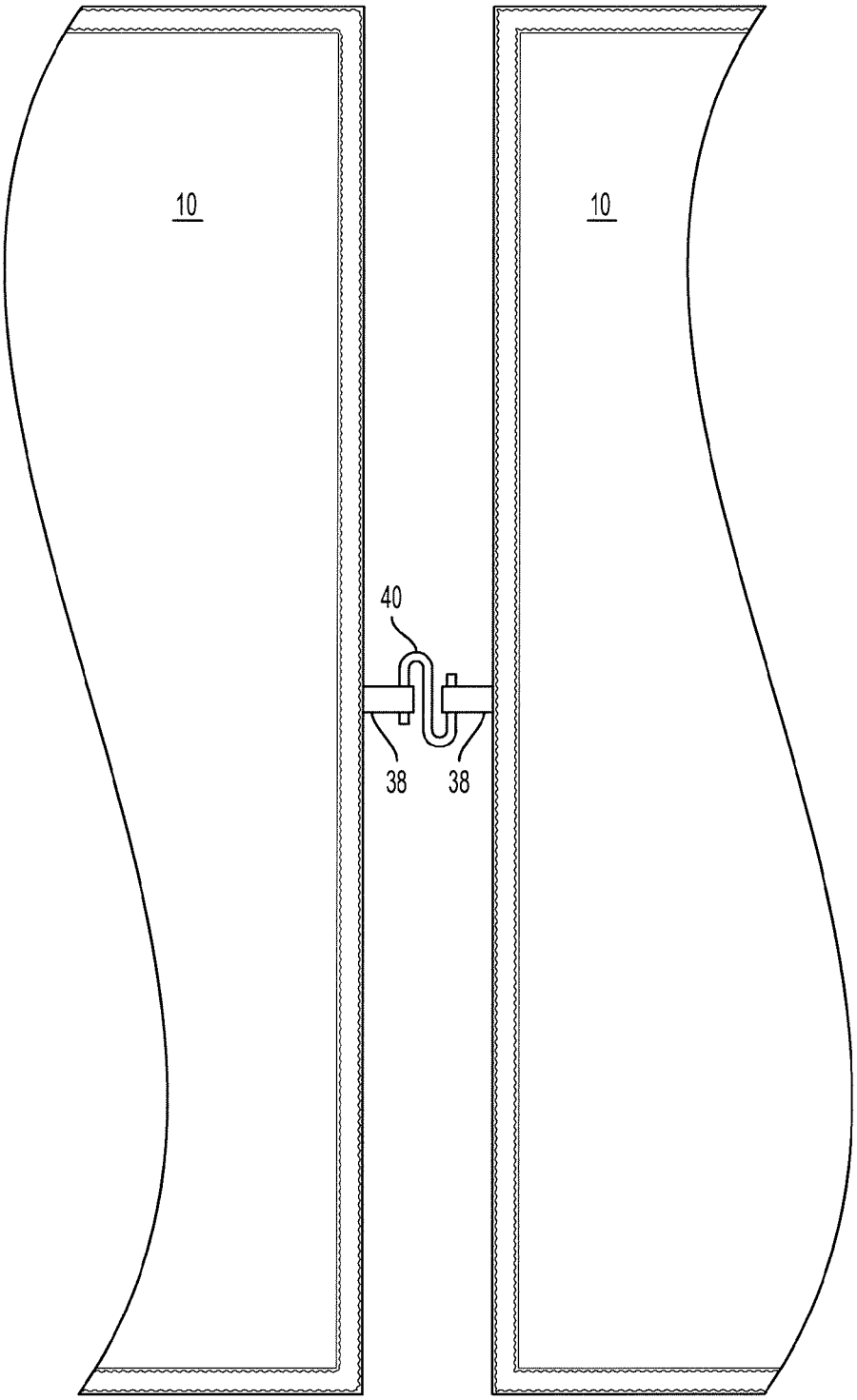
FIG. 5 is an illustration of an interconnection between panels of FIGS. 4A-4D.

The edges of the panels may be provided with spaced connector loops 38, as shown in FIGS. 4A-4D, which may be formed from the same fabric as the layers 32. The loops allow adjacent panels to be joined together by use of appropriate connectors, such a S hooks 40, detailed in FIG. 5, inserted through aligned loops on adjacent panels.

A kit of panels for a particular container will include panels dimensioned to be associated with each of the interior surfaces of the container walls. While the panels for each of the walls may comprise a single element, it may be preferable to incorporate panels for a plurality of adjacent walls into a single composite panel. It also may be advantageous, depending of the size of the container to layered, to form a single wall panel from a plurality of smaller panel elements. Such constructions can facilitate the assembly of the panel system in the container and provide a more compact panel set for shipment and storage before installation.

Accordingly, and as illustrated in FIGS. 4A-4D, A typical kit for a conventional shipping container of nominal dimensions 140 cm (l)×89 cm (w)×98 cm (h) may thus comprise four separate panel pieces 42, 44, 46 and 48. While panels 44, 98×140 cm (FIG. 4B), 46 88×140 cm (FIG. 4C) and 48 88×140 cm (FIG. 4D) are each sized to lie against the front, top and bottom container walls respectively, panel piece 42 (FIG. 4A) is constructed and dimensioned to lie against the rear, right and left sides of the container, with overall dimensions of 98 by 316 mm. It thus comprises (left) side panel 42*a* (98×88 cm); (back) side panel 42*b* (98×140 mm) and (right) side panel 42*c* (98×88 cm), joined together through their respective aligned flaps 32. The flaps may be sewn together, whereby hinge flexibility of the joint is maintained to allow the panels to be folded upon each other for shipment and opened up for installation within the container. Alternatively, the panel 42 may comprise three aligned cores 28 covered by common fabric layers 32, the fabric layers 32 being stitched together about the periphery of the panel as well as between the individual cores to form the interior flaps between the cores.

Panel pieces intended to cover a single side of a container may likewise be formed of two or more sub-panel elements, likewise hingedly joined together through aligned flaps. For example, panels 42*a* and 42*c* in FIG. 4A may be formed from two sub-panels each of 98 by 44 cm, joined along line 50; and panel 42*b* may be formed from two 98 by 70 mm sub-panels. Each of the sub-panels is constructed in the same manner as a full size panel and as illustrated in FIGS. 1 and 2. In likewise manner each of front side (door) panel 44, top side panel 46 and bottom side panel 48 may be formed from two subpanels, the connection lines between the panels being indicated by the dashed lines.

A typical assembly and loading of a container as depicted in FIG. 3 incorporating the present invention is as follows: The container bottom 16 is placed in position, typically on a pallet, and the sidewall unit 20, forming three upright sides and the front side edge, is mounted upon the bottom. The bottom liner panel 48 and three-side liner panel 42 are unfolded, placed in position adjacent the respective walls. The cargo boxes 24 are then placed in the container. The front panel liner 44 and top wall panel liner 46 are then opened and put in position. The top and front liner panels are then put in place, with the top panel fastened to the adjacent side panels through the connector loops 38 and the S hooks 40. The container front and top panels can then be installed, and the container sealed with the contents fully protected by the inner liner.

A pocket or strap 52, may be formed on the inward-lying surface of a panel to accept a small RFID transponder, allowing the location and identity of a container having the invention to be monitored.

Those skilled in the art will appreciate that modifications and adaptations of the invention as described herein may be accomplished without departing from the scope thereof.

I claim:

1. A protective liner for a shipping container having top, bottom and side walls, the liner comprising:

a plurality of panels each having peripheral dimensions chosen to permit each panel to be positioned proximate an inner surface of a different one of the container walls and to overlie substantially the entire inner surface of the wall overlain, each panel having an inner cut-resistant weave layer covered by at least one protective fabric layer, the cut-resistant weave layer having a peripheral edge covered by a protective edging in addition to the protective fabric layer.

2. The protective liner of claim 1, wherein there are two protective fabric layers, one on each side of the cut-resistant weave layer.

3. The protective liner of claim 2 wherein the fabric layers of a panel extend beyond the periphery of the cut-resistant weave layer of the panel, are joined together and form a peripheral flap for the panel.

4. The protective liner of claim 1, wherein the protective edging comprises a solid polymeric foam layer.

5. The protective liner of claim 4, wherein the foam layer is in the form of a tape wrapped around the peripheral edge of the cut-resistant weave layer.

6. The protective liner of claim 1 wherein the cut-resistant weave layer is of galvanized steel.

7. The protective liner of claim 1 wherein the at least one fabric layer is of a non-woven fabric.

8. The protective liner of claim 7 wherein the at least one fabric layer is a polypropylene spunweave.

9. A protective liner panel for container, comprising:

an inner weave layer having peripheral edges;

a polymeric foam edging about the peripheral edges of the weave layer; and at least one outer protective fabric layer extending beyond the peripheral edges of the weave layer and forming a peripheral panel flap.

10. The liner panel of claim 9 further comprising a support member for an RFID transponder.

11. A composite liner panel for an interior of a container, comprising at least two adjacently-positioned panels of claim 9 joined together by an interconnection between aligned portions of the panels' peripheral flaps.

12. The liner panel of claim 11 wherein the interconnection is stitching through the aligned peripheral flap portions to form a hinge connection between the two adjacently-positioned panels.

13. The composite liner panel of claim 12 wherein the composite liner panel is sized to overlie substantially an entire area of one side of the container.

14. The composite liner panel of claim 12 wherein the composite liner panel is sized to overlie substantially an entire area of at least two adjacent container sides, such that a pivot line between two panels aligns with a corner between two container sides that the composite panel overlies.

* * * * *